United States Patent [19]

Mutchler

[11] Patent Number: 4,691,687

[45] Date of Patent: Sep. 8, 1987

[54] PORTABLE AIR HEATING APPARATUS

[75] Inventor: Paul A. Mutchler, University City, Mo.

[73] Assignee: Engineered Air Systems, Inc., St. Louis, Mo.

[21] Appl. No.: 902,493

[22] Filed: Sep. 2, 1986

[51] Int. Cl.[4] ..... F24H 3/06

[52] U.S. Cl. ..... 126/104 A; 237/12.1; 165/47; 165/51

[58] Field of Search ..... 126/104 A, 91 R, 91 A, 126/85 R, 85 B, 9 R, 72, 108; 237/12.1; 165/47, 51, DIG. 12

[56] References Cited

U.S. PATENT DOCUMENTS 2,200,379 5/1940 Williams ..... 237/12.1 X 2,273,502 2/1942 Couse ..... 237/12.1 X 2,410,353 10/1946 McCollum ..... 237/12.1 X 2,412,088 12/1940 Holthhouse ..... 126/104 R X 4,270,695 6/1981 Carson ..... 237/12.1 X

*Primary Examiner*—Larry Jones

*Attorney, Agent, or Firm*—Ralph B. Brick

[57] ABSTRACT

Portable air heating apparatus for supplying heated air to a plenum chamber including a partitioned housing with at least two chambers, one of which is sound-conditioned to contain a power member, the housing having therein a blower and radiator connected to the sound-conditioned power member, a heat exchanger communicating with the blower, heated air passing from the heat exchanger in the housing to the plenum chamber and recirculated therefrom back to the housing over the radiator before returning to the blower.

8 Claims, 1 Drawing Figure

PORTABLE AIR HEATING APPARATUS

BACKGROUND OF THE INVENTION

The present invention relates to air heating apparatus and more particularly to an improved air heater of the portable type which is sound-conditioned and which recirculates air to and from a plenum chamber to be heated.

It is well known to utilize portable heaters to heat plenum chambers housing equipment and personnel in both military and commercial situations. In the past such portable heaters have often been both noisy and inefficient, the noises disturbing personnel who might be working or sleeping in the plenum chamber to be heated and a substantial amount of the heated air introduced from the portable heater into the plenum being wasted. The prior art has recognized the desirability of providing separate stationary compartments for an engine and powered equipment driven thereby, attention being directed to the following U.S. Pat. Nos.: 1,914,075, issued to J. W. Carl on June 13, 1933; 2,696,074, issued to J. Dolza on Dec. 13, 1933 and to Re. 29,923, reissued to Thien et al. on Mar. 6, 1979. The prior art has also recognized the desirability of utilizing radiator heat from a fluid cooled engine to heat ventilating air, attention being directed to U.S. Pat. No. 4,270,695, issued to Miles T. Carson on June 2, 1981. However, the prior art has not recognized the noise and wasted energy problems associated with a portable heater, let alone resolve these problems with a novel heating structure as disclosed hereinafter which is straightforward, economical and efficient in manufacture, assembly and operation and which effectively and efficiently utilizes recirculated air from the plenum which is heated by a heater arrangement that is sound-conditioned to minimize ambient noise.

Various other features of the present invention will become obvious to one skilled in the art upon reading the disclosure set forth hereinafter.

SUMMARY OF THE INVENTION

More particularly, the present invention provides a portable air heating apparatus for supplying heated air to a plenum chamber comprising: a portable housing partitioned into at least two chambers with at least one of the chambers being sound-conditioned and having a power means disposed therein; air heating means including a combustor and heat exchanger disposed in the housing outside the chamber containing the power means, the air heating means communicating with a hot air outlet in the housing through which heated air can be supplied to a heated air inlet in a plenum chamber to be heated; blower means disposed in the housing, the blower means being connected to the power means to deliver air to the air heater means; and, radiator means disposed in the housing outside the chamber containing the power means, the radiator means being connected to the power means to circulate coolant fluid therethrough from and to the power means to control the temperature of the power means, the radiator means communicating with a return air inlet in the housing which can be connected to a return air outlet in the plenum to heat returned air therefrom before it is recirculated through the blower means to the air heating means.

It is to be understood that various changes can be made in one or more of the several parts of the inventive apparatus disclosed herein without departing from the scope or spirit of the present invention. For example, various blower and heater arrangements can be utilized, as can various sound-conditioned compartment arrangements and sound-absorbing materials be utilized in accordance with the teachings of the present invention.

DETAILED DESCRIPTION OF THE DRAWING

Figure 1:
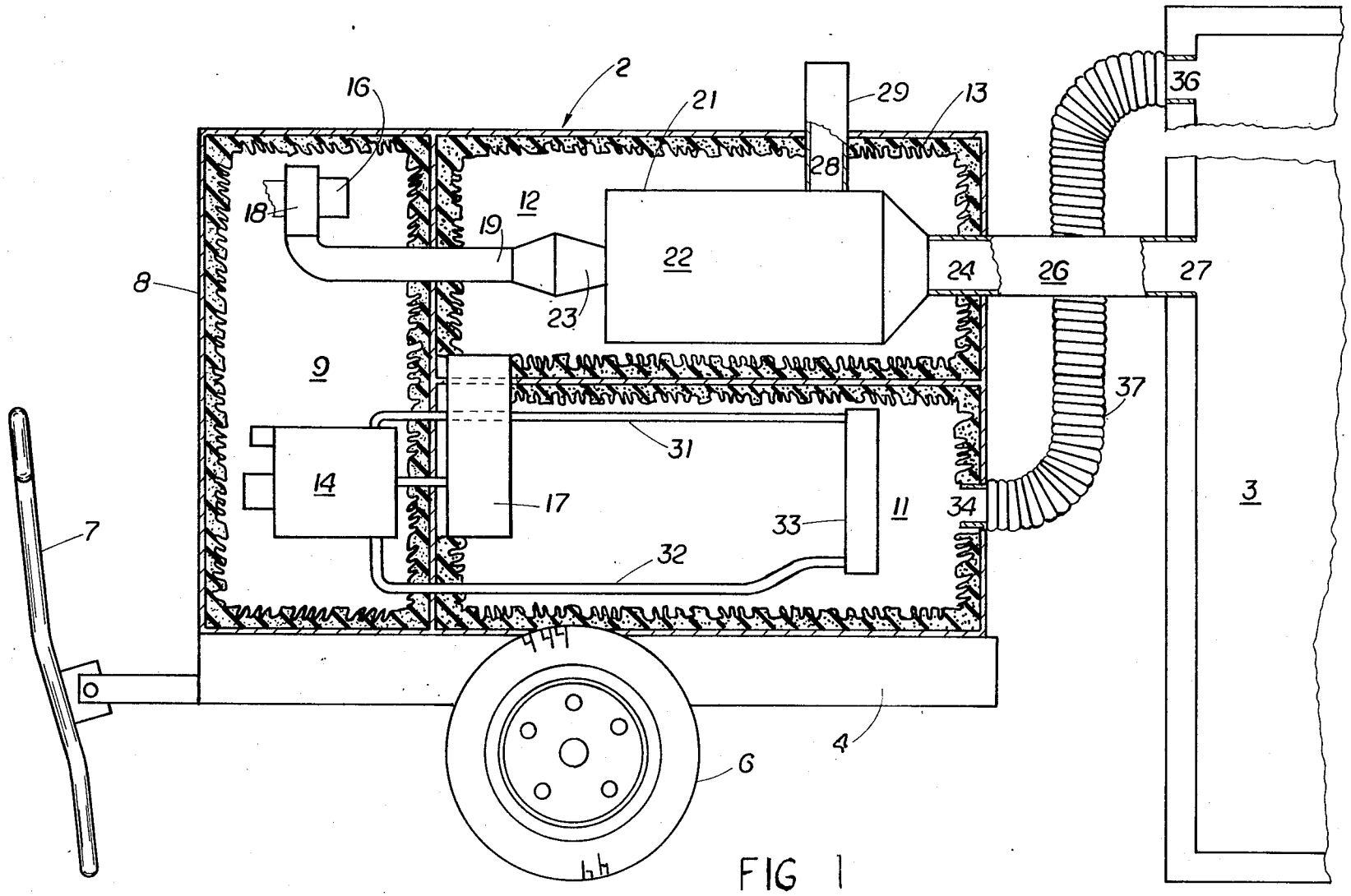
FIG. 1 of the drawing discloses schematically one advantageous embodiment of the present invention.

As can be seen in FIG. 1, there is disclosed a portable air heating apparatus 2 for supplying heated air to plenum chamber 3, which chamber can serve to house personnel or equipment or both.

Portable air heating apparatus 2 includes a portable trailer under carriage 4, mounted and moveable on a pair of wheels 6. A suitable pivotal tow bar 7 is provided at one end of trailer 4 to allow the trailer to be moved by a vehicle (not shown) or to support the trailer end when the air heater mounted thereon is in stationary operating position.

The air heating apparatus includes a housing 8 mounted on the trailer undercarriage 4. As disclosed, housing 8 is divided into three separate sound-conditioned chambers 9, 11 and 12, the walls of each chamber being lined with an appropriate sound-conditioning material. Advantageously, the material can be a saw-tooth foam polyurethane liner such as "SONEX" sold by the Illbruck Company of Minneapolis, Minn. It is to be understood that all of the chambers need not be sound-conditioned, it being essential that the chamber housing the power means, namely chamber 9 in the disclosure, include such a sound-conditioning wall liner 13.

The power means as disclosed can include a larger primary fuel driven engine 14, such as a suitable fluid cooled gasoline or diesel engine, and a smaller secondary engine or motor 16, both power sources being disposed in sound-conditioned chamber 9. Primary power means 14 is shaft connected to a primary blower 17 located in sound-conditioned chamber 11, the primary blower 17 as disclosed being of a centrifugal type with its outlet positioned to deliver an air stream to sound-conditioned chamber 12. The secondary engine or motor 16 is connected to a secondary blower 18 also located in sound-conditioned chamber 9 but arranged to communicate by duct 19 with sound-conditioned chamber 12.

Disposed within chamber 12 is an air heater 21. Air heater 21 (details of which are not disclosed), which can be any one of several types of air heaters known in the art, includes a heat exchanger 22 and a combustor 23. Combuster 23 is connected to duct 19 to permit introduction of air into the combuster 23 from secondary blower 18. Heat exchanger 22 receives air to be heated from blower 17 in chamber 11. In this regard, it is to be noted that heat exchanger 22 is arranged to communicate with a hot air outlet 24 in chamber 12 by means of duct 26 which extends through the heater wall to be connected to the heated air inlet 27 of plenum 3. A suitable combustion gas outlet 28 is provided through which combustion gases can be conducted from heat exchanger 22 by duct 29 to ambient.

To cool the fluid cooled primary engine 14, a fluid coolant is circulated therethrough to absorb the heat therefrom, the fluid being circulated by outlet conduit 31 and return conduit 32 connected to engine 14 and to radiator 33. Radiator 33 is positioned in sound-conditioned chamber 11 adjacent return air inlet 34 in plenum 11. This return air inlet can be connected to return air outlet 36 in plenum 3 by duct 37. In regard, although not disclosed in detail, it is to be understood that hot air duct 26 and return air duct 37 can be of an appropriate flexible type or of an appropriate telescoping type with quick disconnects and appropriate shut-off valves to permit ready connection of heater 4 to plenum 3 when moved into operating position.

In a typical operation of the abovedescribed invention, the power means in the form of primary and secondary power sources 14 and 16 respectively can be started, the sound-conditioning 13 serving to dampen undesirable noises from these power sources. Air to be heated is delivered by blower 17 to heat exchanger 22 and by blower 18 to combustor 23. The heated air from heat exchanger 22 passes through duct 26 into plenum 3 with combustion gases flowing to ambient through duct 29. Return duct 36 serves to recirculate return air from plenum 3 over radiator 11, this air being heated as it passes through radiator 11 by coolant circulated from the heated engine 14 through conduits 31 and 32, before it is reintroduced into blower 17 and recirculated to heat exchanger 22.

It is to be understood that various changes can be made by one skilled in the art in the blower, power sources, and heat exchangers without departing from the scope or spirit of the invention.

The invention claimed is:

1. Portable air heating apparatus for supplying and recirculating heated air to an equipment and personnel housing plenum chamber including a heated air inlet in the lower portion of the plenum chamber and a return air outlet in the upper portion of the plenum chamber comprising:

a portable housing partitioned into at least two chambers with at least one said chambers being sound-conditioned and having a power means disposed therein;

air heating means including a combustor and heat exchanger disposed in said housing outside said chamber containing said power means, said air heating means communicating with a hot air outlet in said housing through which heated air can be supplied through an adjustable duct to a heated air inlet in the lower portion of said plenum chamber to be heated;

blower means disposed in said housing, said blower means being connected to said power means to deliver air to said air heating means; and radiator means disposed in said housing outside said chamber containing said power means, said radiator means being connected to said power means to circulate coolant fluid therethrough from and to said power means to control the temperature of said power means, said radiator means being adjacent to and directly communicating with a return air inlet in said housing which can be connected through an adjustable duct to a return air outlet in the upper portion of said plenum to heat return air therefrom before it is recirculated to said air heating means through said blower means.

2. The apparatus of claim 1, wherein said blower means is disposed in said housing outside said chamber containing said power means.

3. The apparatus of claim 1, wherein said blower means includes two separate blowers, one of which is disposed in said chamber containing said power means and is connected to said air heating means to deliver air to said combustor therefor and the other of which is disposed outside said chamber containing said power means and is connected to said air heating means to deliver air to said heat exchanger means therefor.

4. The apparatus of claim 1, wherein all of the chambers of said portable housing are sound-conditioned.

5. The apparatus of claim 1, wherein said portable housing is partitioned into three chambers, one of which contains said power means, another of which contains said blower and said radiator means and the other of which contains said heating means.

6. The apparatus of claim 1, and a trailer means on which said portable housing is mounted.

7. The apparatus of claim 1, said sound-conditioned chamber having foam polyurethane sheets lining the walls thereof.

8. Portable air heating apparatus for supplying and recirculating heated air to an equipment and personnel housing plenum chamber including a heated air inlet in the lower portion of the plenum chamber and a return air outlet in the upper portion of the plenum chamber comprising:

a portable trailer adapted to be readily moved from one location to another;

a housing mounted on said trailer, said housing being divided into three sound-conditioned chambers, the walls of which are lined with saw-tooth foam polyurethane material;

power means including a large primary fluid cooled fuel driven engine engine and a smaller secondary motor disposed in one of said sound-conditioned chambers of said housing;

blower means including a large primary blower disposed in another of said sound-conditioned chambers of said housing, said primary blower being connected to said large primary fuel driven engine and a secondary smaller blower disposed in said chamber housing said secondary motor to be connected thereto;

air heater means including a combustor and heat exchanger disposed in the other of said sound-conditioned chambers of said housing, said combustor being connected to said secondary smaller blower and said heat exchanger communicating with said larger primary blower, said heat exchanger communicating with a hot air outlet in said chamber through which heated air can be supplied through an adjustable duct to a heated air inlet in the lower portion of a plenum chamber to be heated and with a combustion gas outlet in said chamber through which combustion gases can be conducted to ambient; and, a radiator disposed in said sound-conditioned chamber containing said primary blower to circulate coolant fluid therethrough from and to said primary engine to control the temperature of said engine, said radiator being adjacent to and directly communicating with a return air inlet in said chamber in which it is disposed which can be connected to a return air outlet in the upper portion of said plenum to heat the return air therefrom before it is recirculated through said primary blower in said chamber to said heat exchanger.

* * * * *